US009873542B2

(12) United States Patent
Krutsch

(10) Patent No.: US 9,873,542 B2
(45) Date of Patent: Jan. 23, 2018

(54) SYSTEMS AND METHODS FOR A QUICK START PACKAGING MURAL

(71) Applicant: Digi International Inc., Minnetonka, MN (US)

(72) Inventor: Kenneth Frederick Krutsch, Minnetonka, MN (US)

(73) Assignee: Digi International Inc., Minnetonka, MN (US)

( * ) Notice: Subject to any disclaimer, the term of this patent is extended or adjusted under 35 U.S.C. 154(b) by 349 days.

(21) Appl. No.: 14/017,899

(22) Filed: Sep. 4, 2013

(65) Prior Publication Data

US 2015/0060314 A1 Mar. 5, 2015

(51) Int. Cl.
*B65D 5/42* (2006.01)
*B65D 5/52* (2006.01)

(52) U.S. Cl.
CPC ..... *B65D 5/4233* (2013.01); *B65D 5/5213* (2013.01)

(58) Field of Classification Search
CPC .... B42D 15/00; B65D 5/4233; B65D 5/5213; B65D 5/4212; B65D 5/422; B65D 5/4225; B65D 81/361; B65B 61/20
USPC .... 206/459.5, 232, 738, 722, 762, 753, 774; 283/117; 53/474
See application file for complete search history.

(56) References Cited

U.S. PATENT DOCUMENTS 3,901,384 A * 8/1975 Lee ..... G10G 7/005 206/314
3,945,494 A * 3/1976 Weber ..... G03D 15/001 206/389
4,433,780 A * 2/1984 Ellis ..... B42D 15/022 206/232
4,506,785 A * 3/1985 Seefeldt ..... H05K 13/0069 206/454
4,711,348 A * 12/1987 Schluger ..... B65D 5/422 206/232
4,715,499 A * 12/1987 Franklin ..... B25H 5/00 206/373
5,096,055 A * 3/1992 Opper ..... B65D 5/5213 206/754
6,554,133 B1 * 4/2003 Kropf ..... B65D 85/38 206/320
7,108,172 B2 * 9/2006 Parsadayan ..... G06K 19/0775 206/701
7,386,949 B2 6/2008 Riley
7,878,326 B2 * 2/2011 Andre ..... B65D 25/10 206/320
2004/0069661 A1 * 4/2004 Telleen ..... B65D 5/4233 206/232
2005/0191900 A1 9/2005 Noguchi
(Continued)

*Primary Examiner* — Steven A. Reynolds
(74) *Attorney, Agent, or Firm* — Fogg & Powers LLC

(57) ABSTRACT

Systems and methods for a quick start packaging mural are provided. In certain embodiments, a package includes at least one electronic component; a container enclosing the at least one electronic component, wherein the container protects the at least one electronic component when transported to a user; and a packaging mural within the container, the packaging mural having information about the at least one electronic component, wherein the information and the at least one electronic components are simultaneously viewable when the at least one electronic component is accessible within the container.

9 Claims, 5 Drawing Sheets

(56) References Cited

U.S. PATENT DOCUMENTS

| | | | | |
|---|---|---|---|---|
| 2005/0247598 | A1* | 11/2005 | Reed | B65D 5/22 206/775 |
| 2007/0099542 | A1 | 5/2007 | Sakaguchi et al. | |
| 2007/0120355 | A1 | 5/2007 | Tsukamoto | |
| 2010/0311026 | A1* | 12/2010 | Tomes | A61M 25/002 434/262 |
| 2011/0026205 | A1* | 2/2011 | Plummer | B65D 85/68 361/679.01 |
| 2011/0233079 | A1* | 9/2011 | Macinnes | A61M 25/002 206/232 |
| 2013/0277245 | A1* | 10/2013 | Plummer | B65D 85/68 206/223 |
| 2013/0277252 | A1* | 10/2013 | Moring | B65D 81/113 206/320 |

* cited by examiner

SYSTEMS AND METHODS FOR A QUICK START PACKAGING MURAL

BACKGROUND

Frequently, when a user purchases electronic equipment, the user connects the equipment to other electronics, where the purchased electronics and the other electronics work together to provide a desired functionality. Frequently, to provide the desired functionality, the purchased electronics are connected to the other electronics according to a specific configuration. At times, correctly connecting the electronics may appear challenging to a user. Also, for some users, the initial view of the electronic equipment within the box may incite stress within the user due to fears of incorrectly connecting the equipment. Usually, to guide the user in connecting the electronics in the specific configuration, electronics manufacturers provide instruction manuals that describe detailed steps for connecting different electronic components. However, as the information in the instruction manual is not initially viewable by a user, the instruction manual does little to placate any initial stress felt by the user. Also, instruction manuals may be ignored by a user, which may further add to a user's stress as they try to connect the electronic equipment.

SUMMARY

Systems and methods for a quick start packaging mural are provided. In certain embodiments, a package comprises at least one electronic component; a container enclosing the at least one electronic component, wherein the container protects the at least one electronic component when transported to a user; and a packaging mural within the container, the packaging mural having information about the at least one electronic component, wherein the information and the at least one electronic components are simultaneously viewable when the at least one electronic component is accessible within the container.

DRAWINGS

DETAILED DESCRIPTION

Figure 1A:
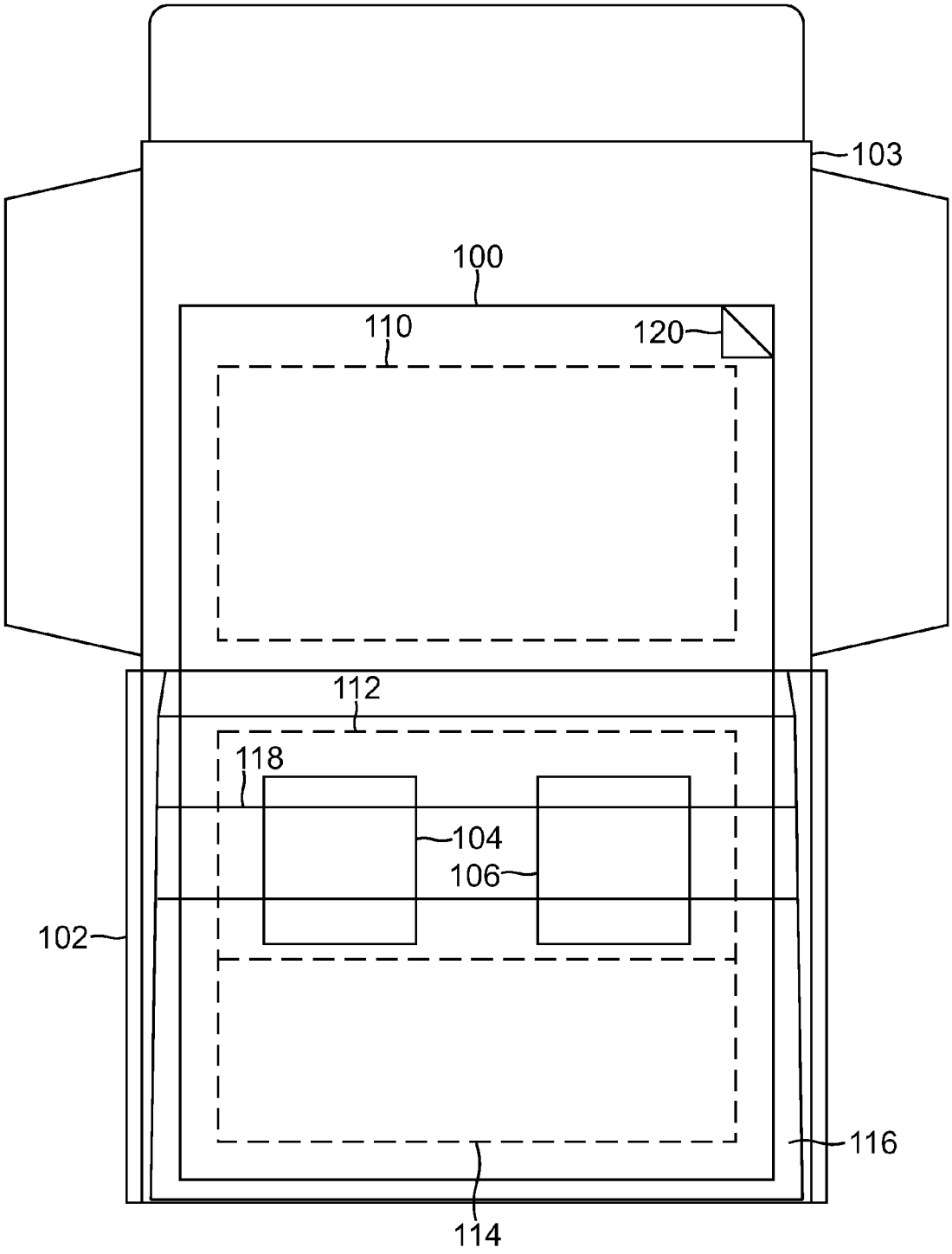
FIG. 1A is an illustration of a top view for an exemplary embodiment of a quick start packaging mural.

FIG. 1A is an illustration of an exemplary embodiment of a packaging mural 100 that is mounted within a container 102. In at least one exemplary embodiment, the container 102 may be a package that is used to protect electronic components when transported from a manufacturer to a user. For example, the container may be a box, a clamshell package, a bag, and the like. As illustrated in FIG. 1A, the container 102 is represented as a box. In the example shown in FIG. 1A, the packaging mural 100 is placed within the container 102 in such a way that when a user opens the container 102, the packaging mural 100 quickly conveys information about components 104 and 106 that are within the container 102. The conveyed information provides easily understood instructions that aids the user in correctly using the components 104 and 106. In one example, the conveyed information facilitates the connection of the components 104 and 106 within a complex larger system. In certain exemplary implementations, to quickly convey the information, upon opening the container 102 to view the components 104 and 106 for the first time a user simultaneously views the packaging mural 100 that may be presented in an easy to understand format. Due to the ease of understanding the presented data on the packaging mural 100, the initial stress at the prospect of using the components 104 and 106 is significantly reduced and the user is more likely to correctly use the equipment in less time.

In certain embodiments, the components 104 and 106 and the packaging mural 100 are placed within a container 102 in such a way that the user is likely to look at the packaging mural 100 when opening the container 102 and removing the components 104 and 106 from the container 102. In at least one example, the packaging mural 100 may have the components 104 and 106 mounted thereon, where the packaging mural 100 illustrates how the components 104 and 106 connect within a larger system. Also, the packaging mural 100 may also convey information describing the intended use of the components 104 and 106.

To convey information, the packaging mural 100 may include multiple information panels. For example, the packaging mural 100 may include an identification panel 112, where the identification panel 112 identifies the components 104 and 106. In at least one implementation, the components are placed over the identification panel 112 to aid in correctly identifying the components 104 and 106. Further, the components may be secured to the identification panel 112 through a securing mechanism 118. The securing mechanism 118 may secure the components 104 and 106 to the identification panel 112 using shrink wrap, tie downs, molded plastic, adhesives, and the like. In at least one exemplary embodiment, the securing mechanism 118 secures the components 104 and 106 in specific locations on the identification panel 112, such that the identification panel 112 clearly conveys identification information to a user.

In a further implementation, the packaging mural 100 includes a connection guide panel 114. In at least one example, the connection guide panel 114 may provide a simplified illustration that shows how the components 104 and 106 connect to other components in a local area network. Generally, the connection guide panel 114 provides instructions on how to electrically connect the components 104 and 106 to other electronic components. In one implementation, the connection guide panel 114 may convey information describing the connection of the components 104 and 106 through an illustration of other components that connect to components 104 and 106.

Further, the packaging mural 100 may include a system overview panel 110. The system overview panel 110 may illustrate how the components 104 and 106 fit within a larger system. For example, the system overview panel 110 may convey information that describes external equipment that receives information from the components 104 and 106 and how that information is conveyed to the external equipment, where the external equipment is not under the control of the user. While the location of the system overview panel 110, the identification panel 112, and the connection guide panel 114 are shown in a particular configuration within FIG. 1A, the different panels may be placed on the packaging mural 100 in a desired arrangement to convey particular information to a user. Also, different panels may be omitted and/or replaced to convey information that a producer desires to convey to a user. For example, alternative panels that provide detailed installation instructions, advertisements, contract information, and the like may be provided.

In at least one implementation, a portion of the packaging mural 100 is folded over the components 104 and 106. Such that when a user opens the lid 103 of the container 102, the user moves the portion of the packaging mural 100 that is folded over the components 104 and 106 so that the portion rests against the open lid 103 of the container 102. As the user moves the packaging mural 100 to view the components 104 and 106, the user may also be encouraged to view the packaging mural 100. In one exemplary embodiment, the portion of the packaging mural 100 that folds over the components 104 and 106 is attached to the lid 103, such that when the container 102 is opened, the packaging mural 100 moves with the lid 103.

In at least one exemplary implementation, the packaging mural 100 may also have information printed on a reverse side from the side that a user views when opening the container 102. To direct a user to the reverse side, the packaging mural 100 may include turn over instructions 120, where the turn over instructions 120 provide instructions to a user that direct the user to turn the packaging mural 100 over and view the reverse side of the packaging mural 100. For example, the reverse side may contain information that includes, a checklist, contract/licensing information, detailed connection instructions, and the like. In at least one implementation, to remove the components 104 and 106 and any needed accessories (like a power supply, cables, and the like) for the components 104 and 106, the user will likely remove the packaging mural 100. As the packaging mural 100 is removed during the removal of components 104 and 106 from the container 102, the user will be encouraged to view the reverse side of the packaging mural 100 without difficulty.

Figure 1B:
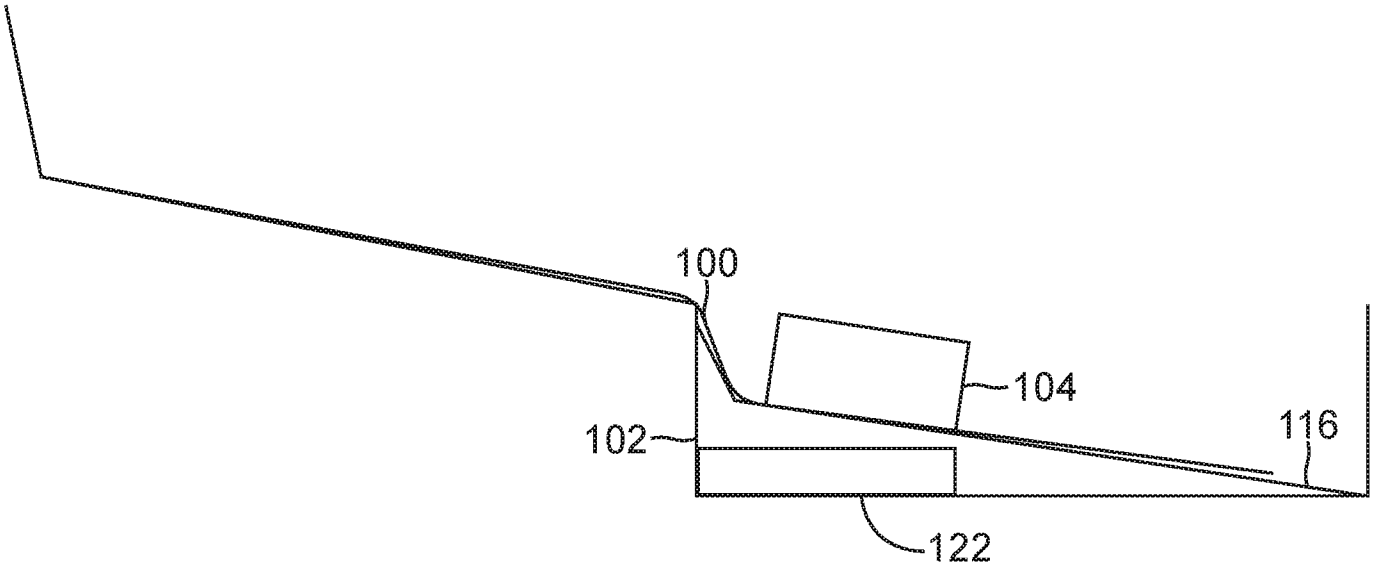
FIG. 1B is an illustration of a side view for an exemplary embodiment of a quick start packaging mural.

In at least one exemplary embodiment, the packaging mural 100 is placed on a ramp 116 or other structure that aids in presenting the packaging mural to a user upon opening of the container 102. For example, FIG. 1B is a cross section of the container 102 that illustrates the shape of one embodiment of a ramp 116. As illustrated, in FIG. 1B, the ramp 116 is shaped in such a way that the information on the packaging mural 100 more directly faces the user, thus facilitating the reading of the packaging mural 100 by the user. Also, the ramp is shaped in such a way that the components 104 and 106 can be secured to the ramp while still allowing the container 102 to close. In at least one implementation, accessories (122) for the components 104 and 106 are placed within the container 102 such that the side of the ramp 116 that faces the accessories (122) is opposite to the side in contact with the packaging mural 100. Thus, to gain access to the accessories (122), the user first removes the packaging mural 100. As described above, the packaging mural 100 aids in conveniently conveying information to a user.

Figure 2:
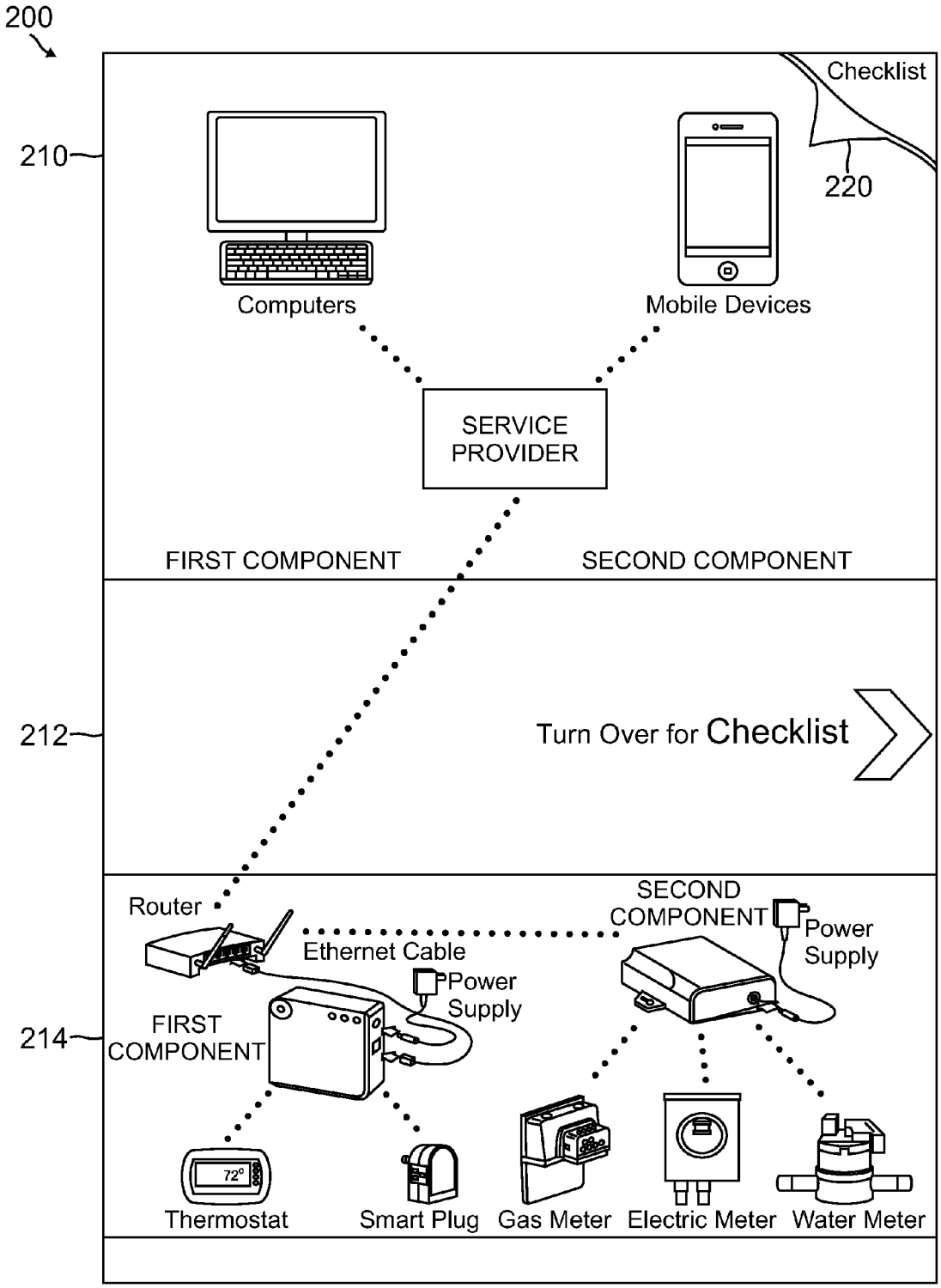
FIG. 2 is an illustration of an exemplary embodiment for a front side of a packaging mural.

FIG. 2 is a detailed illustration of one possible implementation of a packaging mural 200, where the packaging mural 200 imparts information about components that are used to control home utility usage. As illustrated, the packaging mural 200 includes an identification panel 212. When the packaging mural 200 is placed within a container, components, such as components 104 and 106 in FIG. 1, are placed on the packaging mural 200 in such a way that the components are easily identified. For example, packaging mural 200 includes a label "First Component" and a label "Second Component". The first component is placed near the label "First Component" and the second component is placed near the label "Second Component". As the components are placed and secured near their respective labels, the components are easily identified.

Further, the connection guide panel 214 provides an easy to understand illustration of how to connect the first component and the second component to other electrical components. For example, where the first and second components are part of a system for controlling the operation of home utilities, the first component is illustrated as physically connecting to a router through an Ethernet cable and to a power cable that connects to a power supply. The first component further communicates wirelessly with a thermostat and a smart plug. The second component communicates wirelessly with the router connected to the first component and also physically connects to a power supply. Further, the second component wirelessly communicates with utility meters, such as gas, electric, and water meters. In at least one implementation, the depiction of the first component and second component in the connection guide panel 214 appear similar to the first component and second component that are mounted to the identification panel 212.

In another exemplary implementation, the packaging mural 200 includes a system overview panel 210. As shown, the system overview panel 210 illustrates how the components connect to a larger system. For example, as shown in the system overview panel 210, the displayed router in the connection guide panel 214 connects to a service provider that is depicted in the system overview panel. The service provider then communicates through wireless connections with various computers and mobile devices. Further, as described above in relation to FIG. 1, the packaging mural 200 may include turn over instructions 220 that direct a user to view the reverse side of the packaging mural 200.

Figure 3:
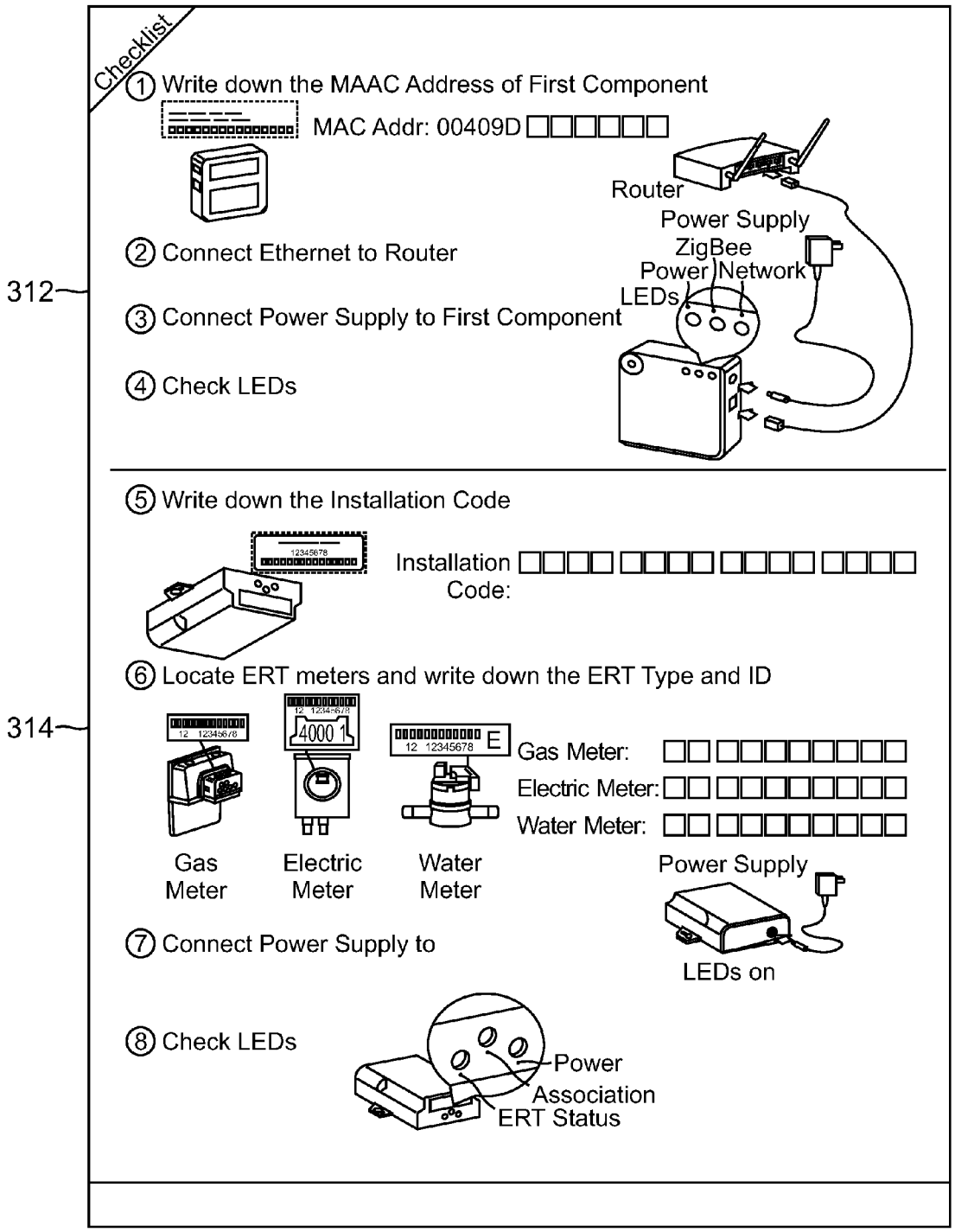
FIG. 3 is an illustration of an exemplary embodiment for a reverse side of a packaging mural in one embodiment described in the present disclosure.

In at least one implementation, the reverse side of the packaging mural 200 includes a checklist of instructions. FIG. 3 illustrates one implementation of a packaging mural 300 that includes a checklist 310. The checklist 310 includes first component instructions 312 for connecting and configuring the first component and second component instructions 314 for connecting and configuring the second component. In at least one example, the first component instructions 312 provide detailed steps to a user when installing and configuring a first component. Likewise, the second component instructions 314 provide detailed steps to a user when installing and configuring a second component. While the examples shown apply to packages having two components, the packaging mural 300 may include instructions for any number of components.

Figure 4:
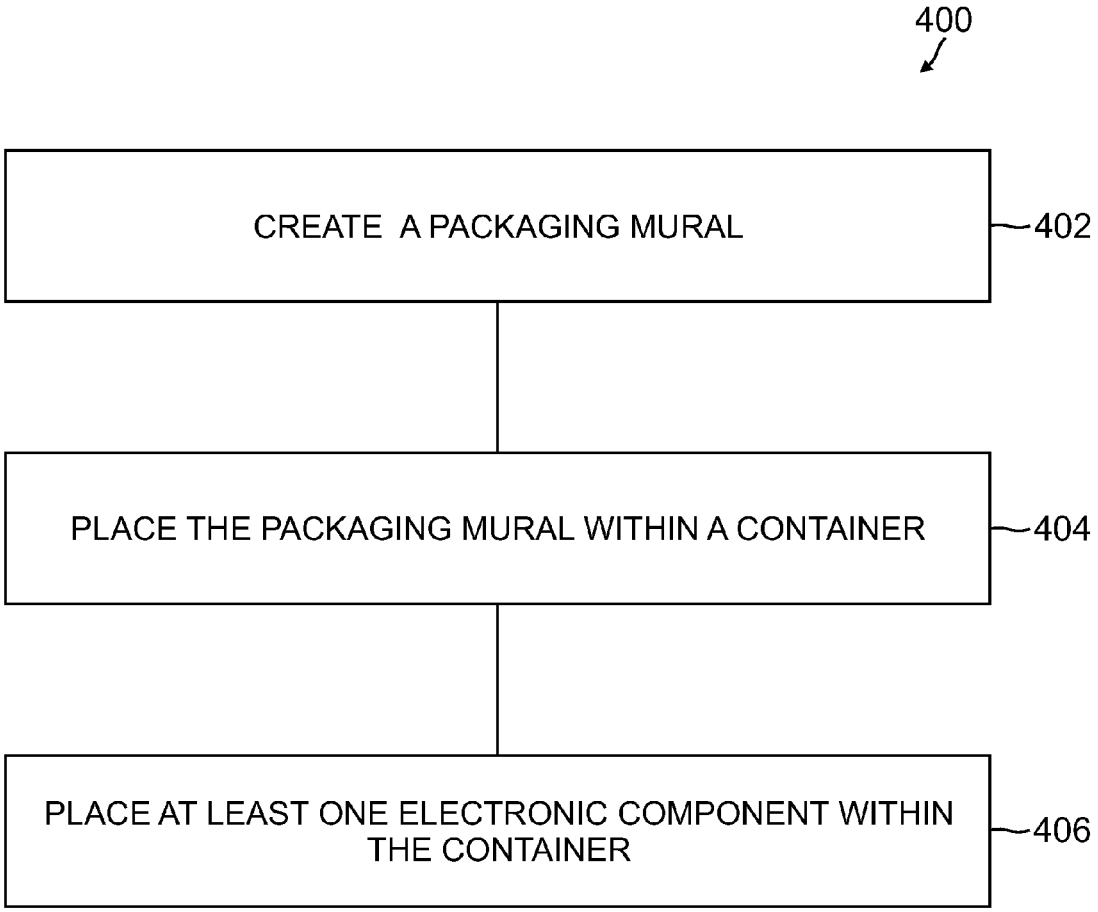
FIG. 4 is a flow diagram of an exemplary embodiment for mounting components in a package having a packaging mural.

FIG. 4 is a flow diagram of one exemplary embodiment of a method 400 of using a packaging mural to convey information about electrical components. The exemplary embodiment shown in FIG. 4 is described here as being implemented using the system shown in FIG. 1A, though it is to be understood that other embodiments can be implemented in other ways.

Method 400 comprises creating a packaging mural 100 (block 402). In one common usage scenario, the packaging mural 100 is a piece of paper, where information that describes electrical components is printed on the paper. For example, the packaging mural 100 may include information that describes how to connect the electrical components to a local system and how the electrical components interact with external components. Further, the packaging mural 100 may also provide information that identifies the electrical components when they are placed on the packaging mural 100 in a particular location on the packaging mural 100.

Method 400 also comprises placing the packaging mural 100 within a container 102 (block 404). In this example, the packaging mural 100 is placed within a container 102 such as a box. In at least one implementation the container 102 is used to transport electrical components to a user from a manufacturer, vendor, or other person that provides the electrical components to the user. In at least one implementation, the packaging mural 100 is placed on a ramp 116 that is located within the container 102. The ramp 116 facilitates the viewing of the packaging mural 100 by the user upon the opening of the container 102.

Method 400 further comprises placing at least one electronic component within the container 102 (block 406). As explained above, when electronic components 104 and 106 are placed within the container 102, they are placed at a location on the packaging mural 100 such that information contained on the packaging mural 100 identifies the electronic components 104 and 106. When a user opens the container 102, the electronic components 104 and 106 and the information on the packaging mural is simultaneously viewable by the user. Further, the electronic components 104 and 106 are secured within the container 102 to prevent the electronic components 104 and 106 from moving in relation to the packaging mural 100 when the container 102 is transported.

EXAMPLE EMBODIMENTS

Example 1 includes a package, the package comprising: at least one electronic component; a container enclosing the at least one electronic component, wherein the container protects the at least one electronic component when transported to a user; and a packaging mural within the container, the packaging mural having information about the at least one electronic component, wherein the information and the at least one electronic components are simultaneously viewable when the at least one electronic component is accessible within the container.

Example 2 includes the package of Example 1, wherein the information describes how to connect the at least one electronic component to other electronic components.

Example 3 includes the package of any of Examples 1-2, wherein the packaging mural comprises an identification panel, wherein the identification panel includes a location for the placement of the at least one electronic components against the packaging mural, wherein the identification panel identifies the at least one electronic components.

Example 4 includes the package of Example 3, wherein the at least one electronic components are secured against the packaging mural on the identification panel within the container.

Example 5 includes the package of any of Examples 1-4, further comprising a ramp within the container, wherein a portion of the packaging mural rests against the ramp, the ramp positioning the packaging mural within the container such that the packaging mural is viewable by a user when the container is open.

Example 6 includes the package of Example 5, wherein accessory electronics are placed between the ramp and the container on an opposite side of the ramp from a side in contact with the packaging mural.

Example 7 includes the package of any of Examples 1-6, wherein the information describes how the at least one electronic component communicates with an external system.

Example 8 includes the package of any of Examples 1-7, wherein the packaging mural comprises further information on a side of the packaging mural that is opposite a viewable side, wherein the viewable side is viewable when the at least one electronic component is accessible within the container.

Example 9 includes the package of Example 8, wherein the side of the packaging mural that is opposite the viewable side contains an installation checklist.

Example 10 includes a method for conveying information to a user, the method comprising: creating a packaging mural, the packaging mural having information about at least one electronic component, placing the packaging mural within a container; placing the at least one electronic component within the container, wherein the at least one electronic component is placed within the container in relation to the packaging mural such that the information and the at least one electronic components are simultaneously viewable when the at least one electronic component is accessible within the container.

Example 11 includes the method of Example 10, wherein the information describes how to connect the at least one electronic component to other electronic components.

Example 12 includes the method of any of Examples 10-11, wherein the packaging mural comprises an identification panel, wherein the identification panel includes a location for the placement of the at least one electronic components against the packaging mural, wherein the identification panel identifies the at least one electronic components.

Example 13 includes the method of Example 12, further comprising securing the at least one electronic component against the packaging mural on the identification panel within the container.

Example 14 includes the method of any of Examples 10-13, further comprising placing the packaging mural on a ramp within the container, wherein a portion of the packaging mural rests against the ramp, the ramp positioning the packaging mural within the container such that the packaging mural is viewable by a user when the container is open.

Example 15 includes the method of Example 14, wherein accessory electronics are placed between the ramp and the container on an opposite side of the ramp from a side in contact with the packaging mural.

Example 16 includes the method of any of Examples 10-15, wherein the information describes how the at least one electronic component communicates with an external system.

Example 17 includes the method of any of Examples 10-16, wherein the packaging mural comprises further information on a side of the packaging mural that is opposite a viewable side, wherein the viewable side is viewable when the at least one electronic component is accessible within the container.

Example 18 includes the method of Example 17, wherein the side of the packaging mural that is opposite the viewable side contains an installation checklist.

Example 19 includes a packaging mural for conveying instructions, the packaging mural comprising: an identification panel, wherein the identification panel includes a location for the placement of the at least one electronic components against the packaging mural, wherein the identification panel identifies the at least one electronic components; a connection guide panel, wherein the connection guide panel provides instructions for connecting the at least one electronic components to other electronic components, wherein the connection guide panel and the identification panel are simultaneously viewable.

Example 20 includes the packaging manual of Example 19, wherein the packaging mural further comprises a system overview panel that provides information that describes how the at least one electronic components interact with external electronic systems.

A number of embodiments have been described. Nevertheless, it will be understood that various modifications to the described embodiments may be made without departing from the spirit and scope of the claimed invention. Also, combinations of the individual features of the above-described embodiments are considered within the scope of the inventions disclosed here.

What is claimed is:

1. A package, the package comprising:

two or more electronic components;

a container enclosing the two or more electronic components, wherein the container protects the two or more electronic components when transported to a user; and a packaging mural within the container, the packaging mural having information about the two or more electronic component, wherein the information and the two or more electronic components are simultaneously viewable when the container is opened to view the two or more electronic components for the first time, wherein, upon the first viewing, the information and the physical position of the two or more electronic components on the packaging mural jointly describe how the two or more electronic components connect within a larger system wherein the packaging mural contains depictions of components in the larger system and depictions of connections between the two or more electronic components and the depictions of the components in the larger system, wherein the depictions of the two or more electronic components in the instructions appear similar to the two or more electronic components.

2. The package of claim 1, wherein the information describes how to connect the two or more electronic components to other electronic components.

3. The package of claim 1, wherein the packaging mural comprises an identification panel, wherein the identification panel includes a location for the placement of the two or more electronic components against the packaging mural, wherein the identification panel identifies the two or more electronic components.

4. The package of claim 3, wherein the two or more electronic components are secured against the packaging mural on the identification panel within the container.

5. The package of claim 1, further comprising a ramp within the container, wherein a portion of the packaging mural rests against the ramp, the ramp positioning the packaging mural within the container such that the packaging mural is viewable by a user when the container is open.

6. The package of claim 5, wherein accessory electronics are placed between the ramp and the container on an opposite side of the ramp from a side in contact with the packaging mural.

7. The package of claim 1, wherein the information describes how the two or more electronic components communicate with one another.

8. The package of claim 1, wherein the packaging mural comprises further information on a side of the packaging mural that is opposite a viewable side, wherein the viewable side is viewable when the two or more electronic components is accessible within the container.

9. The package of claim 8, wherein the side of the packaging mural that is opposite the viewable side contains an installation checklist.

* * * * *